United States Patent [19]

Vanderplaats et al.

[11] 4,107,575

[45] Aug. 15, 1978

[54] FREQUENCY-SELECTIVE LOSS TECHNIQUE FOR OSCILLATION PREVENTION IN TRAVELING-WAVE TUBES

[75] Inventors: Norman R. Vanderplaats, Alexandria, Va.; Henry D. Arnett, Washington, D.C.

[73] Assignee: The United States of America as represented by the Secretary of the Navy, Washington, D.C.

[21] Appl. No.: 729,550

[22] Filed: Oct. 4, 1976

[51] Int. Cl.[2] ..... H01J 25/34

[52] U.S. Cl. ..... 315/3.5; 315/3.6; 315/393

[58] Field of Search ..... 315/3.5, 3.6, 39.3

[56] References Cited

U.S. PATENT DOCUMENTS

| | | | |
|---|---|---|---|
| 3,200,286 | 8/1965 | Rorden | 315/3.5 |
| 3,278,792 | 10/1966 | Blattner | 315/3.6 |
| 3,389,291 | 6/1968 | Ruetz | 315/3.6 |
| 3,397,339 | 8/1968 | Beaver et al. | 315/3.6 X |
| 3,670,197 | 6/1972 | Unger | 315/3.6 |
| 3,903,449 | 9/1975 | Scott et al. | 315/3.6 |
| 4,005,329 | 1/1977 | Manoly | 315/3.6 |

*Primary Examiner*—Saxfield Chatmon, Jr.
*Attorney, Agent, or Firm*—R. S. Sciascia; Philip Schneider; William C. Daubenspeck

[57] ABSTRACT

Backward-wave oscillations in a helix or helix-derived traveling-wave tube are prevented by dimensioning the conductive shell surrounding the helix so that the backward-wave space harmonic of the slow-wave interaction circuit has a cutoff frequency in the vicinity of the frequency of the potential backward-wave oscillations. Lossy material is disposed between the shell and helix so that there is strong coupling between the electromagnetic field and the lossy material near the cutoff frequency of the backward-wave space harmonic.

18 Claims, 12 Drawing Figures

FIG. 1
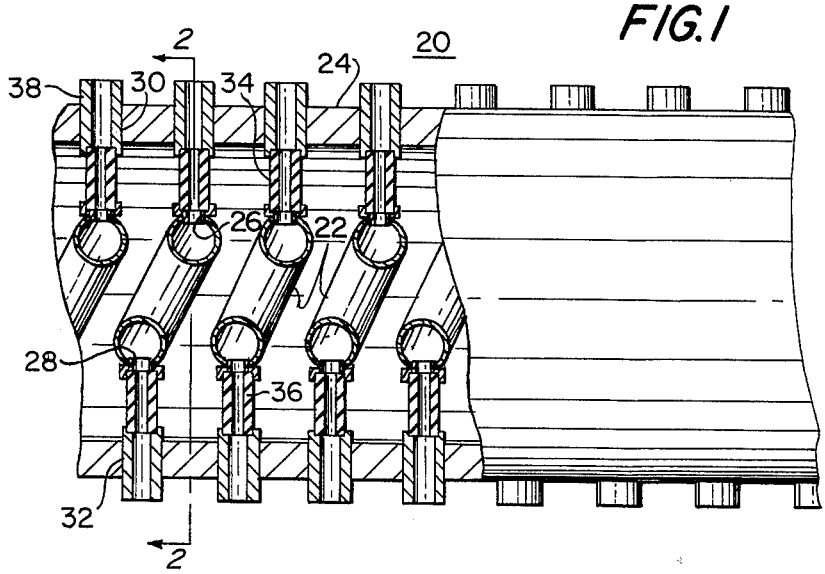
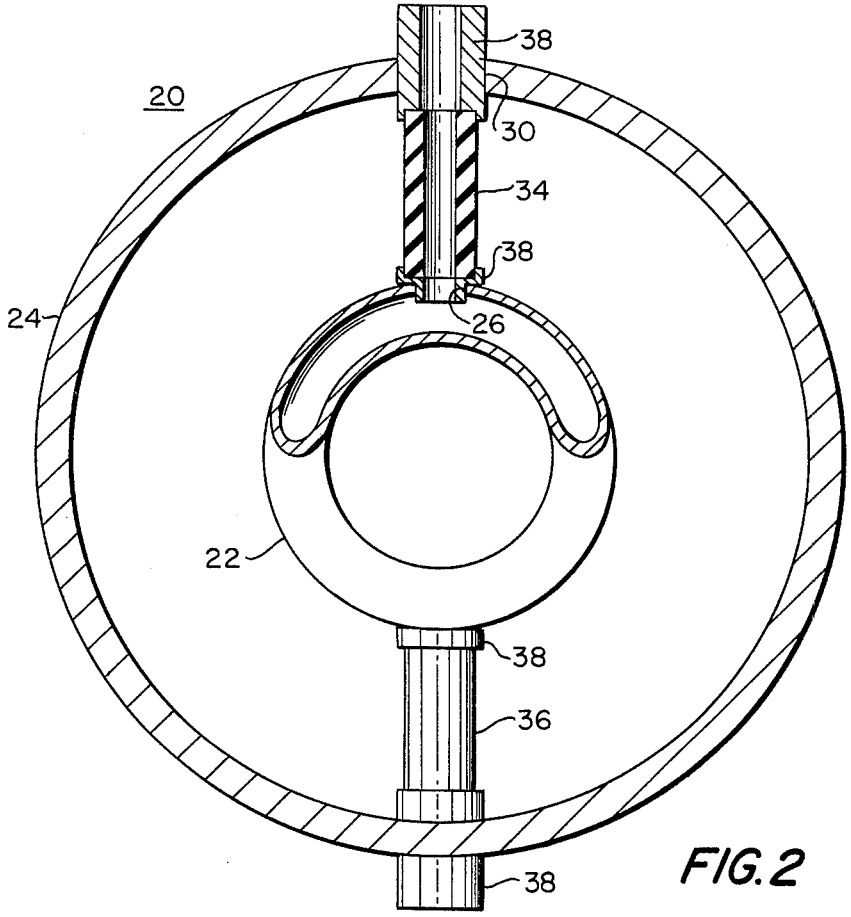
FIG. 2

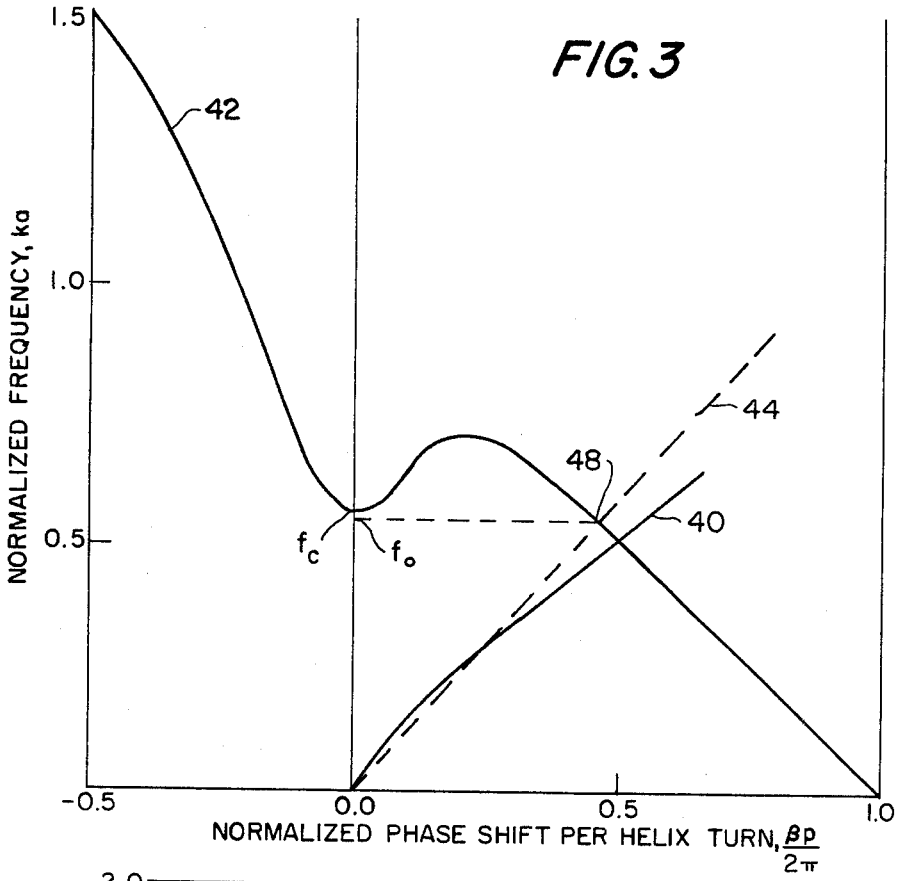
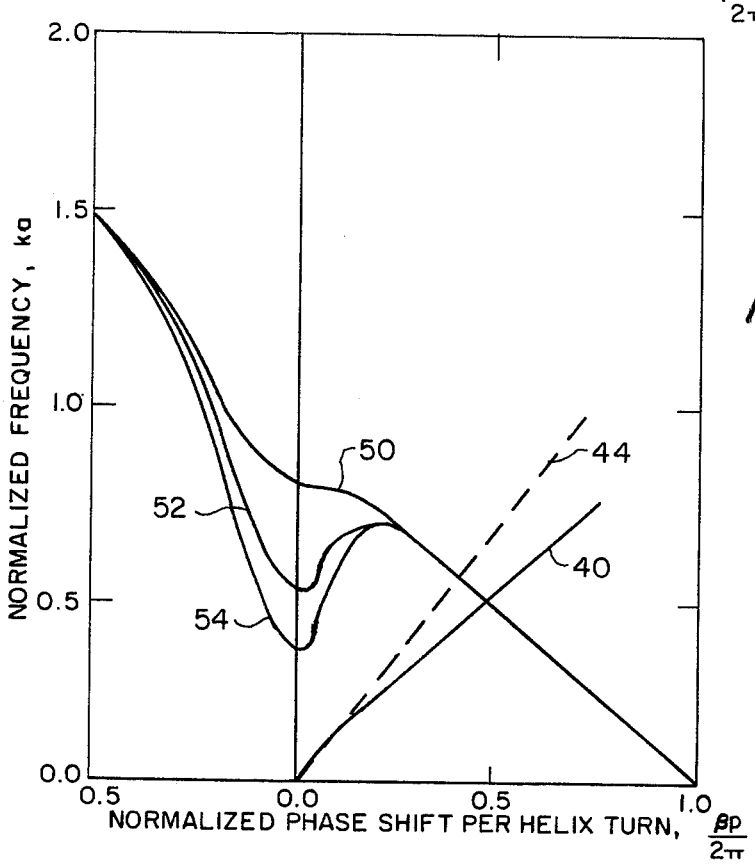
FIG. 4

FREQUENCY-SELECTIVE LOSS TECHNIQUE FOR OSCILLATION PREVENTION IN TRAVELING-WAVE TUBES

BACKGROUND OF THE INVENTION

This invention relates generally to traveling-wave tubes and more particularly to arrangements for preventing backward-wave oscillations in helix or helix-derived slow-wave interaction structures.

Helix traveling-wave tubes are widely used in commercial and military power applications where wide bandwidth is a primary requirement. The conventional helix traveling-wave tube provides the greatest bandwidth of any microwave power source but has inherent stability limitations which have prevented high power output. The tendency for backward-wave oscillations to occur is the primary deterrent to increasing the peak power attainable from helix traveling-wave tubes. The backward-wave oscillations at unwanted frequencies can cause beam modulation that substantially reduces the output power at the desired frequency. Prior art methods to reduce backward-wave oscillations in general have tended to greatly reduce the bandwidth, power, and efficiency of the traveling-wave tubes.

Prior methods of reducing the tendency for backward-wave oscillations to occur include distributed RF loss, phase velocity tapering axially along the beam, periodic circuit perturbations to produce a frequency stopband, a small beam diameter to minimize backward-wave interaction, and a short helix length between the sever and output. All of these methods have drawbacks which severely limit the tube efficiency, bandwidth, and pulse-up capability (dual-mode tube), or require excessive magnetic forcusing fields or mechanical complexity. Some types of traveling-wave tubes using helix-derived circuits such as the ring-bar circuit or the strapped bifilar helix can generate higher peak power but are severely limited in bandwidth capability and are difficult to fabricate. These helix-derived devices also often have severe stability problems associated with backward-wave oscillations or band-edge oscillations.

SUMMARY OF THE INVENTION

Accordingly, it is an object of the present invention to provide improved bandwidth, power and efficiency in traveling-wave tubes employing helix or helix-derived interaction circuits.

Another object of the present invention is to prevent backward-wave oscillations in traveling-wave tubes employing helix or helix-derived interaction circuits.

A further object of the present invention is to provide frequency-selective loss in traveling-wave tubes employing helix or helix-derived interaction circuits, said loss being much greater in the region of backward-wave interaction than in the operating frequency range.

These and other objects of the present invention are attained by providing a helix circuit assembly which is dimensioned so that the −1 space harmonic of the slow-wave interaction structure is coupled strongly to lossy materials which are disposed between the conductive shell and the circuit. Specifically the circuit and shell geometry is chosen so that the −1 space harmonic has a cutoff frequency in the vicinity of the frequency of the potential backward-wave oscillations. Lossy supports are disposed between the shell and the circuit to strongly couple with the electric and magnetic fields of the −1 space harmonic in the vicinity of the cutoff frequency. A traveling-wave tube constructed according to the present invention will display a high RF loss in the region of backward-wave interaction but maintain low loss in the operating frequency range.

The present invention may be best understood by reference to the following detailed description when considered in conjunction with the accompanying drawings wherein:

BRIEF DESCRIPTION OF THE DRAWINGS

FIG. 1 is a sectional elevation view of an embodiment of a helix circuit assembly constructed in accordance with the present invention;

FIG. 2 is a cross-sectional view of the embodiment of FIG. 1 taken along line 2—2 in FIG. 1;

FIG. 3 is a plot of normalized frequency versus normalized phase shift per helix turn for the fundamental and the backward-wave modes calculated for a sheath helix model;

FIG. 4 is a plot of normalized frequency versus normalized phase shift per helix turn calculated for three sheath helix models illustrating the effect of the shell-to-helix diameter ratio on the backward-wave mode;

DESCRIPTION OF THE PREFERRED EMBODIMENTS

Figure 6:
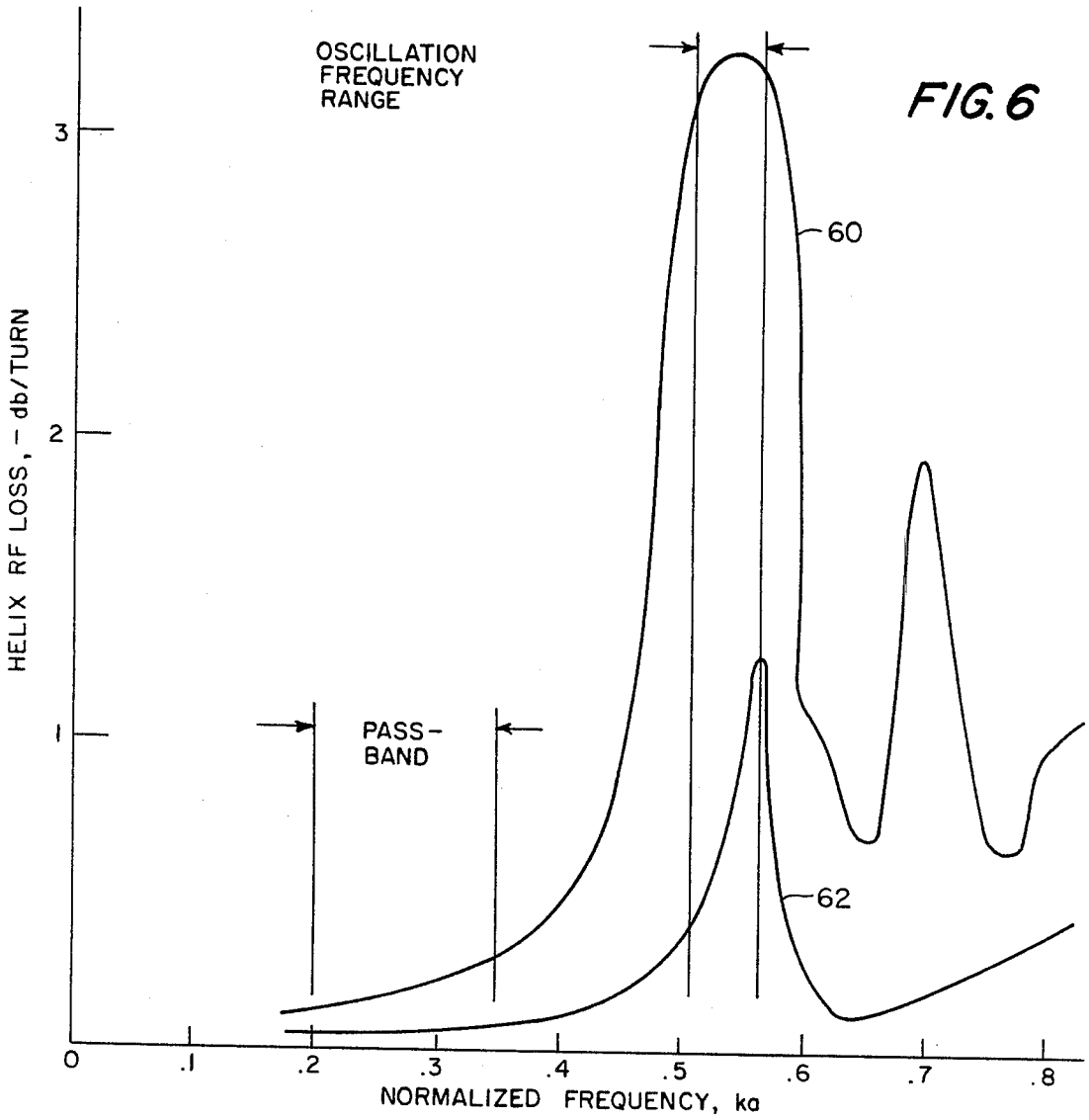
FIG. 6 is a graph of radio-frequency loss as a function of normalized frequency for traveling-wave tubes employing the helix circuit assembly of FIG. 1.

Referring now to the drawings, wherein like reference characters designate like or corresponding parts throughout the several views, and more particularly to FIGS. 1 and 2, a section of a helix circuit assembly 20 of a traveling-wave tube is shown having a tubular metal helix 22 coaxially disposed within a conductive metal shell 24. The helix 22 has a series of apertures 26, 28 aligned in a pair of diametrically opposed longitudinal rows azimuthally positioned at 0° and 180° along the outside of the helix; thus each turn of the helix has a pair of apertures formed in the outside wall thereof and the apertures are disposed in a pair of diametrically opposed rows running the length of the helix. The conductive shell 24 has a series of apertures 30 and 32 disposed in a pair of diametrically opposed rows running the length of the shell with each aperture of the shell positioned opposite a corresponding aperture of the helix.

The helix 22 is supported within the conductive shell 24 by a series of insulating support tubes 34 and 36 which extend between the apertures in the helix and apertures in the shell so that communication is established between the corresponding apertures in the helix and the shell. Support tubes 34 and 36 are tubular ceramics having tubular metal extensions 38 on each end. The metal extensions 38 of support tubes 34 and 36 are joined to helix 22 and to shell 24 by brazing so that a high pressure fluid-tight seal is formed, thereby establishing a vacuum chamber within the shell and providing a means for fluid communication between the helix and a fluid reservoir (not shown) outside the shell.

A suitable scheme for providing fluid flow through the helix and the support tubes is disclosed in U.S. Pat. No. 3,617,798, issued Nov. 2, 1971, by Theodore J. Marchese et al., and assigned to the same assignee as the present invention.

The helix circuit assembly depicted in FIG. 1 incorporates the frequency-selective loss technique of this invention to induce high loss in the region of backward-wave interaction and thus suppress oscillations. As will presently be explained, the shell 24 is dimensioned so that the $-1$ space harmonic (backward-wave) of the circuit has a cutoff frequency and a low group velocity near the potential backward-wave oscillation frequency. Dielectric and magnetic lossy materials are positioned in a manner taught by this invention between the helix and the shell so that the $-1$ space harmonic fields in the region of the cutoff frequency are strongly coupled to the lossy material. A traveling-wave tube constructed according to the present invention displays a loss peak in the region of the backward-wave interaction which is much greater than the loss at the operating frequency.

Figure 5:
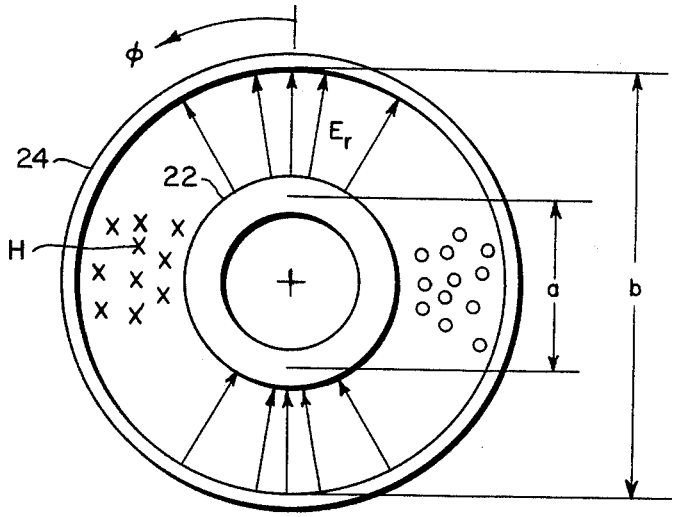
FIG. 5 is a cross-sectional view of a helix circuit assembly of a traveling-wave tube illustrating the electric and magnetic field orientation associated with the −1 space harmonic at cutoff frequency.

The frequency-selective loss technique of the present invention may be best understood with further reference to FIGS. 3, 4 and 5. FIG. 3 shows the calculated dispersion characteristics for the fundamental forward-wave and lowest order backward-wave modes of a sheath helix model if the shell diameter is 2.67 times the helix diameter and for no dielectric loading. The fundamental forward-wave mode is represented by curve 40, the backward-wave mode is represented by curve 42, and the electron beam velocity is represented by the dashed line 44. For the sheath helix mathematical model, the circuit is uniform (not periodic) and the separate modes are orthogonal so that the relative amplitudes depend only on the excitation. The actual helix is a periodic structure for which the electromagnetic field near the helix boundary can be expressed as a Fourier series of space harmonics. The separate modes of the sheath helix model are replaced in the actual helix by these space harmonics which are coupled together in such a way that the boundary conditions at the helix are satisfied. These space harmonics are separated in phase from each other by $2\pi$ radians per helix turn. Lossy dielectric or magnetic material can be coupled to the circuit through the electromagnetic fields associated with any of the space harmonics, but the space harmonics with low phase shift (near $\beta = 0$) usually have large amplitude and thus can potentially provide strong coupling to lossy materials.

Efficient amplification in a helix traveling-wave tube occurs if the velocity of the electron beam is slightly greater that the phase velocity of the fundamental space harmonic of the slow-wave interaction circuit. The deleterious backward-wave oscillations occur approximately at the frequency $f_o$ where the electron beam velocity intersects the lowest order backward-wave space harmonic of the circuit (point 48). This lowest order backward-wave space harmonic is designated herein as the $-1$ space harmonic because it is described by the $n = -1$ term of the Fourier series expression of the electromagnetic field for the structure. These oscillations can be prevented if the circuit is made to have high loss at frequency $f_o$.

FIG. 3 shows that the calculated backward-wave mode for the sheath helix model (curve 42) and the $-1$ space harmonic of the actual helix circuit have a cutoff near $\beta p = 0$ and in the vicinity of the oscillation frequency $f_o$. The mode pattern of the $-1$ space harmonic is similar to the $TE_{11}$ mode of a coaxial line with an outer-conductor diameter equal to the conductive shell diameter and an inner-conductor diameter equal to the helix diameter. The coaxial line and the $-1$ space harmonic have nearly the same cutoff frequency and electromagnetic field configuration near cutoff. At the cutoff frequency, the current in the coaxial line flows circumferentially around the inner conductor with zero flow in the axial direction. For a helix or a helix-derived circuit, the current flow is nearly circumferential in the vicinity of the cutoff frequency $f_c$. The cutoff frequency $f_c$ for $-1$ space harmonic (and the coaxial line) is given approximately by $$k_c a = (2\pi a f_c/c) \approx (2/1 + b/a)\,(\mathrm{DLF})$$

where $k_c a$ = normalized cutoff frequency
$a$ = average helix diameter
$b$ = shell inside diameter
$c$ = velocity of light
DLF = a factor, usually in the range of 0.8 - 1.0, to account for dielectric loading and wall perturbations.

For the case depicted in FIG. 3, the shell-to-circuit diameter ratio (2.67) was chosen so that the backward-wave space harmonic would have its cutoff frequency near the frequency $f_o$. FIG. 4 shows the computed dispersion, based on the sheath-helix model, for three shell-to-circuit diameter ratios. Curves 50, 52, and 54 show the computed dispersion for shell-to-circuit diameter ratios of 1.5, 2.67 and 4.47, respectively. It can be seen that with the selection of suitable helix and shell dimensions, the cutoff frequency of the $-1$ space harmonic can be adjusted to approach the potential backward-wave oscillation frequency.

Referring now to FIG. 5, the electric and magnetic field lines of the $-1$ space harmonic at cutoff are depicted for a helix circuit assembly having a helix 22 axially disposed within a conductive shell 24. The electric field is oriented primarily in the radial direction and its magnitude varies as $\cos\phi$; the magnetic field is oriented primarily in the axial direction and its magnitude varies as $\sin\phi$. Lossy dielectric materials placed in the region of maximum electric field, near $\phi = 0°$ or $\phi = 180°$, will be strongly coupled to the circuit near frequency $f_c$. Similarly, magnetic loss material will cause circuit attenuation near frequency $f_c$ if the material is placed along $\phi = 90°$ or $\phi = 270°$, the region where the magnetic field is maximum. The loss coupling at the cutoff frequency $f_c$ is very strong due to the relative orientation of the lossy material and the circuit fields, and is enhanced by the low group velocity of the $-1$ space harmonic near cutoff.

In operation, a radio-frequency wave is introduced into helix 22 at an inlet microwave coupler (not shown in the figures). A beam of electrons from an electron gun (not shown) is directed along the axis of the helix and is collected at the exit end by a collector (also not shown). The radio-frequency wave traveling along helix 22 is amplified by interaction with the electron beam traveling down the axis of the helix in a manner well known in the art. The amplified wave is then extracted at a conventional coupler (not shown).

Referring now to the embodiment shown in FIG. 1, the tubular insulating supports 34 and 36 allows lossy dielectric fluid to be circulated within the supports and the helix. Because the relative shell and helix dimensions have been adapted according to the oscillation techniques taught hereinbefore so that the $-1$ space harmonic has a cutoff near the potential backward-wave oscillation frequency of the circuit, the $-1$ space harmonic is strongly attenuated in the region of potential backward-wave interaction due to coupling with the lossy fluids in supports 34 and 36. This embodiment also has excellent cooling capability since the circulating fluid may be used to remove the heat generated by RF losses in the helix and by impingment of the electron beam on the helix. It should be apparent that the invention may be practiced with a nonmoving fluid at the expense of losing some of the heat-removal capability.

FIG. 6 shows RF loss per turn as a function of normalized frequency for two experimental helix circuit assemblies constructed in accordance with the embodiment of FIG. 1. Curve 60 is for a helix circuit assembly that has a shell-to-helix diameter ratio of 2.40; curve 62 is for a circuit assembly that has a shell-to-helix diameter ratio of 2.67. Water was used as the lossy fluid in both assemblies, and the support tubes of the helix circuit assembly of curve 60 have an inner cross-sectional area that is approximately three times the inner cross-sectional area of the support tubes of curve 62. It can be seen that a loss peak occurs at normalized frequencies in the range of $ka = 0.5$ to 0.7, which is in the frequency range needed to prevent backward-wave oscillations, and that the greater cross-sectional area of lossy fluid in the assembly of curve 60 results in a greater loss per helix turn.

From well-known perturbation theory, it is apparent that many other geometrical variations of the helix circuit assembly of FIG. 5 will provide a frequency-selective loss peak at the desired frequency $f_o$ for oscillation suppression as taught by the present invention. For example, referring to FIG. 5, the cutoff frequency $f_c$ can be lowered by an inward wall perturbation in the region of $\phi = 0°$ and $\phi = 180°$, by an outward wall perturbation in the region of $\phi = 90°$ and $100 = 270°$, or by increased dielectric or magnetic loading material anywhere between the helix and the shell. The perturbation methods can be utilized to adapt the frequency-selective loss technique to applications where it is desired to reduce the shell-to-helix diameter ratio. These applications include high-frequency traveling-wave tubes with helix-derived circuits in which a periodic focusing system is utilized for beam containment. By suitable wall or material perturbation, high loss can be achieved in the frequency range for oscillation suppression.

Figure 8:
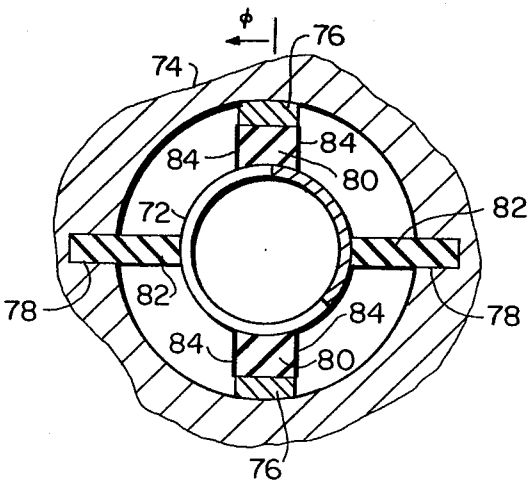
FIG. 8 is a cross-sectional view of the embodiment of FIG. 7 taken along lines 8—8.
Figure 7:
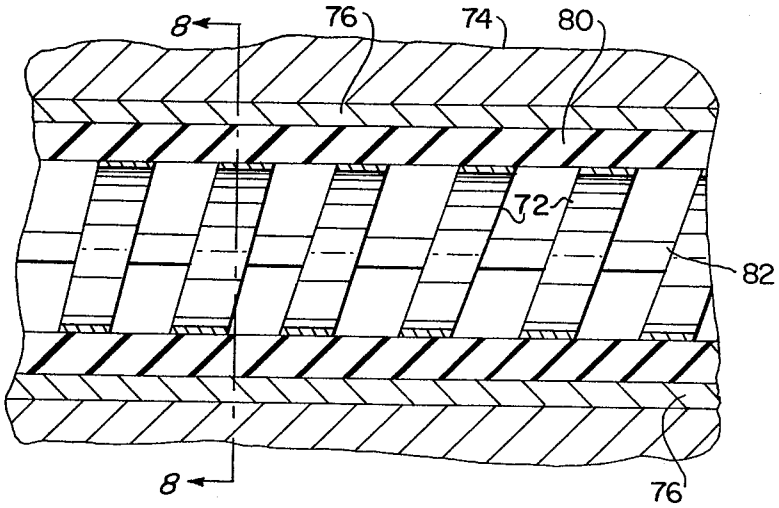
FIG. 7 is a sectional elevation view of a second embodiment of a helix circuit assembly constructed in accordance with the present invention.

Turning now to FIGS. 7 and 8, there is depicted a helix circuit assembly of a traveling-wave tube employing a variation of the selective RF loss mechanism as taught by the present invention. A tape-helix slow-wave interaction circuit 72 is coaxially disposed within a cylindrical conductive shell 74. A pair of longitudinal metal ridges 76, shaped on the outside to match the inside contour of the conductive shell 74, provide an inward wall perturbation around $\phi = 0°$ and 180°. Shell 74 has a pair of longitudinal grooves 78 located at $\phi = 90°$ and 270° which provide outward wall perturbations. The helix 72 is supported within the shell 74 by a first pair of insulating supports 80 that extend between the longitudinal ridges 76 and the helix, and by a second pair of insulating supports 82 that extend between the longitudinal grooves 78 and the helix. Guided by the perturbation theory, standard cold-test procedures may be used to determine the dimensions which will cause the $-1$ space harmonic to have a cutoff in the region of potential backward-wave oscillations.

A lossy coating 84 is applied between the helix 72 and the metal ridges 76 to the sides of the first pair of insulating supports 80. The electric field of the $-1$ space harmonic near the cutoff frequency will be strongly coupled to the dielectric coating 84 so that the circuit will have high loss in the region of the cutoff frequency. The second pair of insulating supports 82 may be a lossy magnetic material, such as ferrite, to provide coupling with the magnetic field. Both types of loss materials may be used simultaneously. In this embodiment, support rods 80 and 82 may also serve to remove the heat generated by the circuit.

Figure 10:
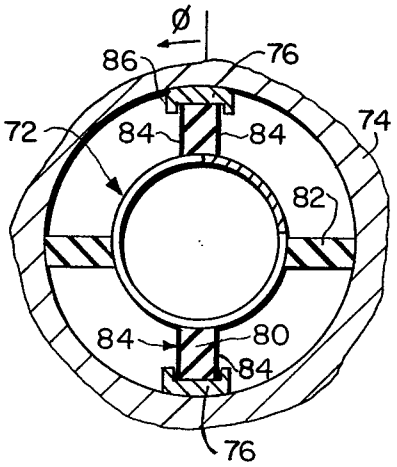
FIG. 10 is a cross-sectional view of the embodiment of FIG. 9 taken along lines 10—10.
Figure 9:
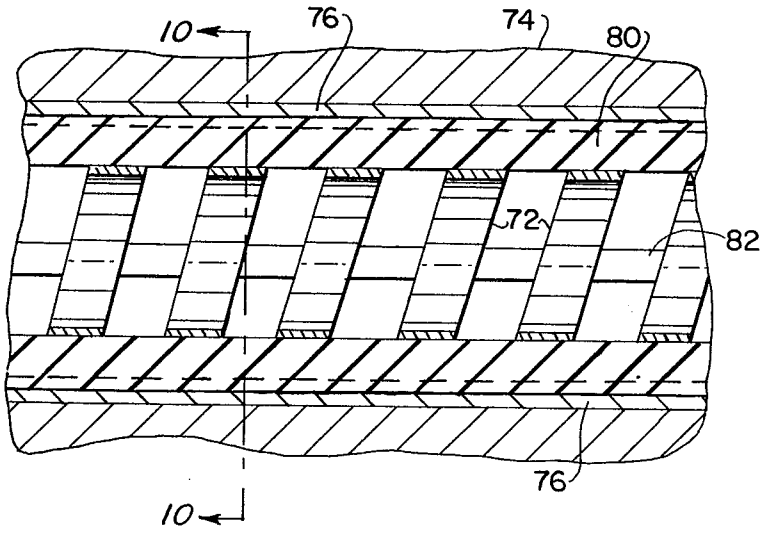
FIG. 9 is a sectional elevation view of a third embodiment of a helix circuit assembly constructed in accordance with the present invention.

FIGS. 9 and 10 depict a variation of the embodiment shown in FIG. 7 which may be easier to fabricate because the grooves 78 are eliminated. Inward wall perburbations (metal ridges 76) are used in conjunction with a slightly larger conductive shell (the grooves 78 being eliminated) to lower the cutoff frequency and establish the proper electromagnetic field orientation to prevent backward-wave oscillations. In this embodiment, the longitudinal metal ridges 76 have metal vanes 86 which extend toward the helix 72 and are parallel to and separated from the first pair of insulating supports 80. The vanes aid in reducing RF breakdown by decreasing the electric field at the junction between the insulating supports 80 and the metal ridges 76.

Figure 12:
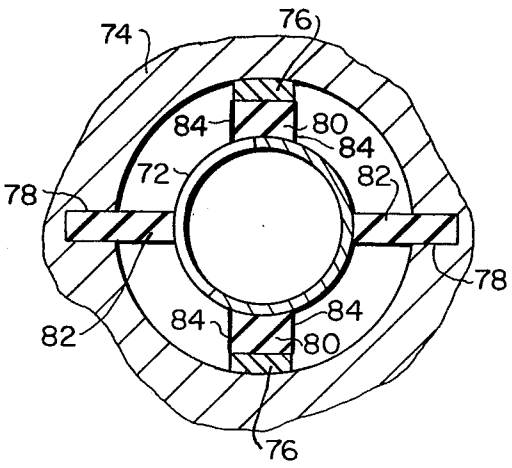
FIG. 12 is a cross-sectional view of the embodiment of FIG. 11 taken alongs lines 12—12.
Figure 11:
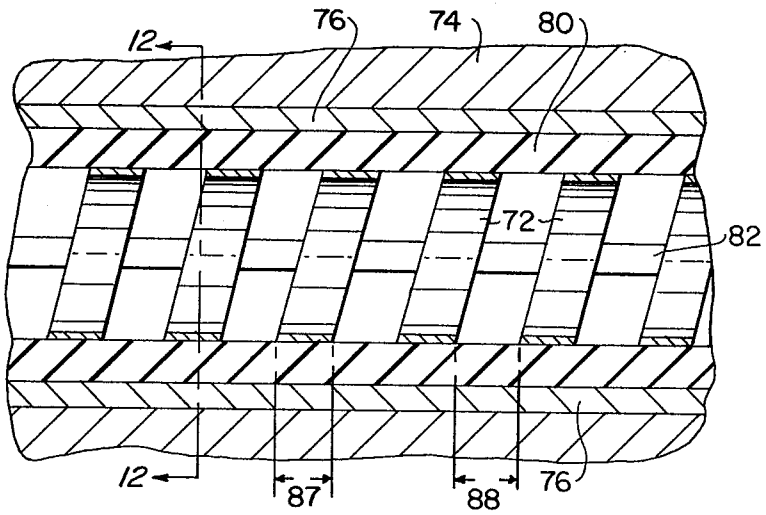
FIG. 11 is a sectional elevation view of a fourth embodiment of a helix circuit assembly constructed in accordance with the present invention.

FIGS. 11 and 12 depict a variation of the embodiment of FIG. 7 that has improved loss selectively. The lossy coating 84 is applied to the first pair of insulating supports 80 between helix and the shell only in the region of the helix turns 87. There is no lossy coating applied to the insulating supports 80 in the region between the helix turns 88. As previously taught, the electric fields are oriented primarily in the radial direction with very little axial component at the cutoff frequency of the $-1$ space harmonic. Since the electric field lines terminate on the circuit conductor, the absence of the lossy coating between turns will have little effect on the loss coupling near the cutoff frequency. However, because there is a substantial axial component of the electric fields in the operating band, the absence of lossy material between the helix turns in the embodiment of FIG. 11 will result in lower RF loss in the operating band in the embodiment of FIG. 11 than in the embodiment of FIG. 7.

Although the present invention has been described hereinbefore with application to the simple helix interaction circuit, the frequency-selective loss techniques are applicable to any helix-derived circuit which posesses a space harmonic that has electric fields that vary as the fields of the $-1$ space harmonic of the simple helix interaction circuit vary. For example, the techniques of the present invention are applicable to the strapped bifilar helix, ring-bar structures, and numerous other variations of helix-derived circuits. Many lossy materials, such as lossy fluids, thin conductive films, carbon applied in various ways, mixtures containing silicon carbide, lossy anisotropic materials such as ferrites, or other forms of lossy dielectric or magnetic materials may be employed in implementing the techniques of the present invention. The lossy materials need not have frequency-selective properties, but loss resonance or increasing loss with frequency is beneficial.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. In a traveling-wave tube of the type wherein a beam of electrons flows along the axis of a slow-wave interaction circuit through which an electromagnetic wave propagates, said slow-wave interaction circuit being axially disposed within a conductive metal shell, the improvement comprising means for preventing backward-wave oscillations, said preventing means comprising:

means for producing a cutoff frequency of the −1 space harmonic of the slow-wave interaction circuit at or near zero-phase-shift per period of the slow wave circuit and at or near the frequency of the potential backward-wave interaction between said beam of electrons and said −1 space harmonic; and lossy material disposed between said slow-wave interaction circuit and said conductive shell, said lossy material being disposed so as to couple strongly with the electromagnetic field of said −1 space harmonic in the vicinity of said cutoff frequency.

2. The improvement in a traveling-wave tube as recited in claim 1 wherein:

said lossy material disposed between said slow-wave interaction circuit and said conductive shell comprises lossy dielectric material disposed between said slow-wave interaction circuit and said conductive shell, said dielectric material being positioned in the region of maximum electric field of said −1 space harmonic at said cutoff frequency.

3. The improvement in a traveling-wave tube as recited in claim 1, wherein:

said lossy material disposed between said slow-wave interaction circuit and said conductive shell comprises magnetic loss material disposed between said slow-wave interaction circuit and said conductive shell, said magnetic loss material being positioned in the region of maximum magnetic field of said −1 space harmonic at said cutoff frequency.

4. In a traveling-wave tube of the type wherein a beam of electrons flows along the axis of a helically-shaped, tubular, slow-wave interaction circuit through which an electromagnetic wave propagates, said helically-shaped slow-wave interaction circuit being axially disposed within a conductive metal shell, the improvement comprising means for preventing backward-wave oscillations, said preventing means comprising:

means for producing a cutoff frequency of the −1 space harmonic of the slow-wave interaction circuit at or near zero-phase-shift per period of the slow wave circuit and at or near the frequency of the potential backward-wave interaction between said beam of electrons and said −1 space harmonic; and a plurality of tubular, insulating supports radially disposed between said slow-wave interaction circuit and said conductive shell, said supports being filled with lossy dielectric fluid, said supports being azimuthally positioned along the length of said slow-wave interaction circuit in the region of maximum electric field of said −1 space harmonic at said cutoff frequency, said lossy dielectric fluid coupling strongly with the electric field of said −1 space harmonic near said cutoff frequency thereby strongly attenuating said −1 space harmonic in the vicinity said cutoff frequency.

5. In a traveling-wave tube of the type wherein a beam of electrons flows along the axis of a slow-wave interaction circuit through which an electromagnetic wave propagates, said slow-wave interaction circuit being axially disposed within a conductive metal shell, the improvement comprising means for preventing backward-wave oscillations, said preventing means comprising:

means for producing a cutoff frequency of the −1 space harmonic of the slow-wave interaction circuit at or near zero-phase-shift per period of the slow wave circuit and at or near the frequency of the potential backward-wave interaction between said beam of electrons and said −1 space harmonic; and a first insulating support, said first support disposed longitudinally between said shell and said slow-wave interaction circuit, said first support azimuthally positioned in the region of the maximum electric field of the −1 space harmonic of the circuit at said cutoff frequency, said first support having a lossy dielectric coating extending between said slow-wave interaction circuit and said shell for coupling loss to said −1 space harmonic.

6. The improvement in a traveling-wave tube as recited in claim 5 further comprising:

a second insulating support, said second support being disposed longitudinally between said shell and said slow-wave interaction circuit, said second support being azimuthally positioned in the region of maximum magnetic field of said −1 space harmonic at said cutoff frequency.

7. The improvement in a traveling wave tube as recited in claim 6 wherein said second support comprises lossy magnetic material.

8. A method of preventing backward-wave oscillations in a traveling-wave tube of the type wherein a beam of electrons flows along the axis of a slow-wave interaction circuit through which an electromagnetic wave propagates, said slow-wave interaction circuit being axially disposed within a conductive shell, said method comprising the steps of:

spacing the internal surface of said conductive shell from said slow-wave interaction circuit so that the −1 space harmonic of the circuit has a cutoff frequency at or near zero-phase-shift per period of the slow wave circuit and at or near the frequency of the potential backward-wave interaction with said beam of electrons; and disposing lossy material between said slow-wave interaction circuit and said conductive shell to couple strongly with the electromagnetic field of said −1 space harmonic of the circuit in the vicinity of said cutoff frequency, thereby strongly attenuating said −1 space harmonic in the vicinity of said cutoff frequency.

9. The method of preventing backward-wave oscillations as recited in claim 8 wherein the step of disposing lossy material comprises:

disposing lossy dielectric material between said slow-wave interaction circuit and said conductive shell so as to couple strongly with the electric field of said −1 space harmonic in the vicinity of said cutoff frequency.

10. The method of preventing backward-wave oscillations as recited in claim 9 wherein the step of disposing lossy material further comprises:

disposing magnetic loss material between said slow-wave interaction circuit and said conductive shell so as to couple strongly with the magnetic field of said −1 space harmonic in the vicinity of said cutoff frequency.

11. A helix circuit assembly for use in a traveling-wave tube of the type wherein a beam of electrons flows along the axis of a slow wave interaction circuit through which an electromagnetic wave propagates and having means for preventing backward-wave oscillations, said circuit assembly comprising:

a slow-wave interaction circuit;

a conductive, metal, outer shell disposed coaxially with said interaction circuit and spaced therefrom so that the −1 space harmonic of said interaction circuit has a cutoff frequency at or near zero-phase-shift per period of the slow wave circuit and at or near the frequency of the potential backward-wave interaction between said beam of electrons and said −1 space harmonic; and lossy material disposed between said interaction circuit and said shell, said lossy material disposed so as to couple strongly with the electromagnetic field of said −1 space harmonic in the vicinity of said cutoff frequency thereby strongly attenuating said −1 space harmonic in the vicinity of said cutoff frequency.

12. A helix circuit assembly for use in a traveling-wave tube of the type wherein a beam of electrons flows along the axis of a slow wave interaction circuit through which an electromagnetic wave propagates and having means for preventing backward-wave oscillations, said circuit assembly comprising:

a tubular, helically-shaped slow-wave interaction circuit;

a conductive, metal, outer shell coaxially disposed with said interaction circuit and space therefrom so that the −1 space harmonic of said interaction circuit has a cutoff frequency at or near zero-phase-shift per period of the slow wave circuit and at or near the frequency of the potential backward-wave interaction between said beam of electrons and said −1 space harmonic; and a plurality of tubular, insulating supports radially disposed between said interaction circuit and said shell, said supports being filled with lossy dielectric fluid, said supports being positioned azimuthally along the length of the interaction circuit in the region of maximum electric field of said −1 space harmonic at said cutoff frequency.

13. A helix circuit assembly for use in a traveling-wave tube of the type wherein a beam of electrons flows along the axis of a slow wave interaction circuit through which an electromagnetic wave propagates and having means for preventing backward-wave oscillations, said circuit assembly comprising:

a tape helix slow-wave interaction circuit;

a conductive, metal, outer shell coaxially disposed with said interaction circuit and spaced therefrom so that the −1 space harmonic of said interaction circuit has a cutoff frequency at or near zero-phase-shift per period of the slow wave circuit and at or near the frequency of the potential backward-wave interaction between said beam of electrons and said −1 space harmonic;

a first insulating support, said first support being disposed longitudinally between said shell and said interaction circuit, said first support being azimuthally positioned in the region of the maximum electric field of said −1 space harmonic at said cutoff frequency, said first support having a lossy dielectric coating extending between said interaction circuit and said shell for coupling loss to said −1 space harmonic; and a second insulating support, said second support being disposed longitudinally between said shell and said interaction circuit, said second support being azimuthally positioned in the region of maximum magnetic field of said −1 harmonic at said cutoff frequency.

14. The helix circuit assembly of claim 13 wherein said second insulating support comprises magnetic loss material.

15. A helix-derived circuit assembly for use in a traveling-wave tube of the type wherein a beam of electrons flows along the axis of a slow wave interaction circuit through which an electromagnetic wave propagates and having means for preventing backward-wave oscillations, said circuit assembly comprising:

a helix-derived slow-wave interaction circuit;

a conductive, metal, outer shell coaxially disposed with said interaction circuit and spaced therefrom so that the backward-wave space harmonic of said interaction circuit has a cutoff frequency at or near zero-phase-shift per period of the slow wave circuit and at or near the frequency of the potential backward-wave interaction between said beam of electrons and said −1 space harmonic; and lossy material disposed between said interaction circuit and said conductive shell, said lossy material being disposed so as to couple strongly with the electromagnetic field of said backward-wave space harmonic in the vicinity of said cutoff frequency.

16. The helix circuit assembly of claim 11 wherein said outer shell further comprises outward wall perturbations around 100 equals 90° and 270° where $\phi$ is the azimuthal angle measured from the top of the shell.

17. The helix circuit assembly of claim 11 wherein said outer shell further comprises inward wall perturbations around 100 equals 0° and 190°, where $\phi$ is the azimuth angle measured from the top of the shell.

18. The helix circuit assembly of claim 17 wherein said outer shell further comprises outward wall perturbations around $\phi$ equals 90° and 270°.

* * * * *